US009062397B2

(12) United States Patent
Barea

(10) Patent No.: US 9,062,397 B2
(45) Date of Patent: Jun. 23, 2015

(54) SIMPLIFIED SYSTEM AND METHOD FOR MANAGING THE FEED OF A PLURALITY OF YARNS AT CONSTANT TENSION AND/OR VELOCITY TO A TEXTILE MACHINE

(71) Applicant: Tiziano Barea, Busto Arsizio (IT)

(72) Inventor: Tiziano Barea, Busto Arsizio (IT)

(73) Assignee: BTSR INTERNATIONAL S.P.A., Olgiate Olona (Varese) (IT)

( * ) Notice: Subject to any disclaimer, the term of this patent is extended or adjusted under 35 U.S.C. 154(b) by 0 days.

(21) Appl. No.: 14/374,255

(22) PCT Filed: Jan. 29, 2013

(86) PCT No.: PCT/IB2013/000101

§ 371 (c)(1),
(2) Date: Jul. 24, 2014

(87) PCT Pub. No.: WO2013/114174

PCT Pub. Date: Aug. 8, 2013

(65) Prior Publication Data

US 2015/0039120 A1 Feb. 5, 2015

(30) Foreign Application Priority Data

Feb. 3, 2012 (IT) ..... MI2012A0141

(51) Int. Cl.

| | |
|---|---|
| ***G06F 19/00*** | (2011.01) |
| ***D04B 15/99*** | (2006.01) |
| ***D04B 35/12*** | (2006.01) |
| ***D04B 15/48*** | (2006.01) |

(52) U.S. Cl.

CPC ..... *D04B 15/99* (2013.01); *D04B 35/12* (2013.01); *D04B 15/48* (2013.01); *D10B 2509/028* (2013.01)

(58) Field of Classification Search

CPC ..... D04B 15/48; D04B 15/66; D04B 15/99; D04B 35/12; B65H 51/30; B65H 59/38–59/388; B65H 2701/31; B65H 61/00; B65H 61/005

USPC ..... 700/140–144

See application file for complete search history.

(56) References Cited

U.S. PATENT DOCUMENTS 5,566,574 A * 10/1996 Tiziano ..... 73/862.473
5,838,570 A * 11/1998 Barea ..... 700/143

(Continued)

FOREIGN PATENT DOCUMENTS

| | | |
|---|---|---|
| DE | 3002311 A1 | 7/1981 |
| EP | 2067886 A1 | 6/2009 |

OTHER PUBLICATIONS

International Search Report and Written Opinion mailed Jun. 6, 2013 for PCT/IB2013/000101 to BTSR INTERNATIONAL S.P.A. filed Jan. 29, 2013.

*Primary Examiner* — Nathan Durham

(74) *Attorney, Agent, or Firm* — Novak Druce Connolly Bove + Quigg LLP

(57) ABSTRACT

A system and method for managing the feed of a plurality of yarns at constant tension and/or velocity to a textile machine of circular, loom or yarn preparation type, the yarns being fed to the machine by a corresponding plurality of feed devices. Setting controller is provided, connected to the plurality of devices and arranged to set their operation, the setting controller receiving synchronization signals from the machine and measuring on the basis of these signals every portion of an article production cycle, the cycle being divided into different stages, the setting controller acting on each individual feed device on the basis of the stages such that each feed device feeds the respective yarn with predefined tension and/or velocity individual to each of the stages.

12 Claims, 1 Drawing Sheet

(56) References Cited

U.S. PATENT DOCUMENTS

| | | | | |
|---|---|---|---|---|
| 6,321,576 | B1 * | 11/2001 | Barea | 66/132 R |
| 6,418,977 | B1 * | 7/2002 | Tholander | 139/452 |
| 6,550,285 | B2 * | 4/2003 | Nishitani | 66/146 |
| 7,699,258 | B2 * | 4/2010 | Barea | 242/365.7 |
| 7,896,282 | B2 * | 3/2011 | Barea | 242/418 |
| 2005/0061388 | A1 * | 3/2005 | Josefsson | 139/452 |
| 2005/0173579 | A1 * | 8/2005 | Barea | 242/365.7 |
| 2008/0256983 | A1 | 10/2008 | Weber | |
| 2009/0139271 | A1 | 6/2009 | Barea | |

* cited by examiner

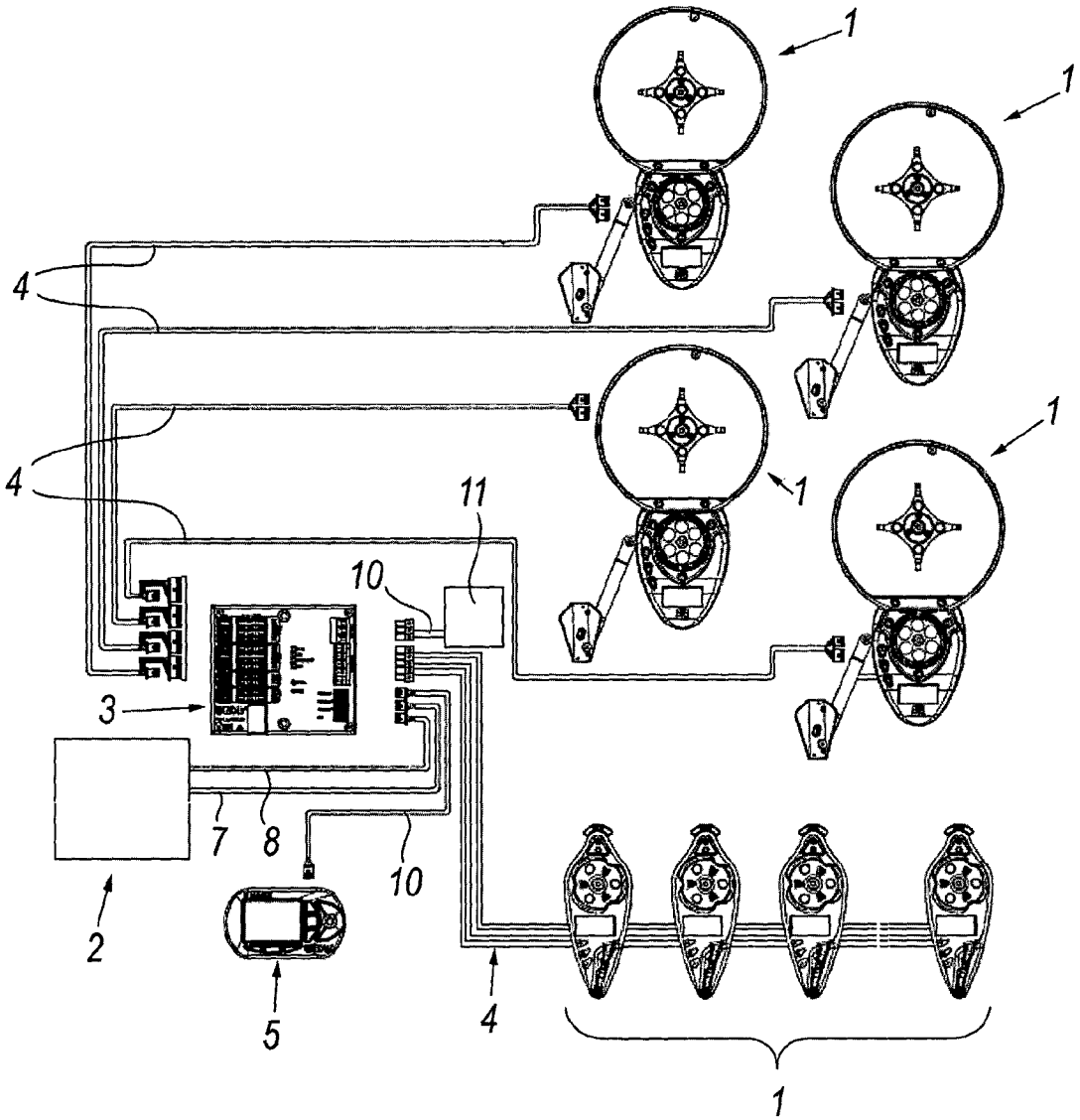
1
1
1
1
1
4
4
4
11
10
10
8
7
3
2
5

SIMPLIFIED SYSTEM AND METHOD FOR MANAGING THE FEED OF A PLURALITY OF YARNS AT CONSTANT TENSION AND/OR VELOCITY TO A TEXTILE MACHINE

CROSS-REFERENCE TO RELATED APPLICATIONS

This is a §371 National Stage Application of International Application No. PCT/IB2013/000101 filed on 29 Jan. 2013, claiming the priority of Italian Patent Application No. MI2012A000141 filed on 3 Feb. 2012.

The present invention relates to a simplified system and method for managing the feed of a plurality of yarns at constant tension and/or velocity to a textile machine, in accordance with the introduction to the corresponding independent claims.

In particular, the invention relates in non-limiting manner, to the management of a plurality of feeders at constant tension and/or velocity for the production of a stocking or other article of graduated compression. Devices are known to the expert of the art able to feed a yarn to a textile machine while maintaining the yarn tension and/or velocity constant and uniform at a set point reference value. In a machine such as a knitting machine or for stocking or web production, a plurality of yarns are fed to the textile machine, these yarns being fed by corresponding feeders of the aforesaid type.

During the production of numerous articles (such as medical stockings, tights, tapes, etc.) the need often arises to modify the set point value (relative to the tension and/or velocity) of said feeders in order to obtain a particular effect in the finished article, as is the case for example in graduated compression stockings.

The producer of such articles is known to require the facility to manage the set point of feeders on the basis of the operative state of the textile machine; in particular, it is required to define for each stocking zone (cuff, leg, ankle, heel, foot, toe), in the specified example, or for another article with parts obtained in differentiated manner (for example swimming costumes, industrial clothing, variable length webs, or the like), the feed tension and/or velocity for each yarn and the manner (velocity) with which the feed device has to pass from one set point to the other as the various article working zones vary.

Two possible solutions are currently known to this problem, valid both in the case of constant tension feeders and in the case of constant velocity feeders; for this reason the following examples, although referring to constant tension feeders, are also valid in the case of constant velocity feeders.

In a first known solution, many feed devices comprise one or more digital inputs through which to manage the modifications to the set point tension (in the case of small and medium diameter circular machines the term "graduations" is used). In this case the operator uses one or more digital outputs, normally present in textile machines and freely programmable, to be connected to the feeder inputs; the operator uses digital signals to modify the set point of each device within the machine operating programme (in the case of small and medium diameter circular machines the term machine "chain" is used).

However this known solution has numerous limits. In particular, "dated" textile machines do not always present digital outputs, hence creating "retrofit" problems for machines already existing on the market, including the fact that different cabling has to be used from machine to machine.

Moreover, the said known solution comprises the use of at least one digital output from the machine for each feed device associated with it to enable the operator to programme the set point of each device independently; the solution hence requires a large number of programmable machine outputs, which are not always available.

In addition, the known art compels the operator to intervene on the machine "chain" and hence on the machine programme to make any modification to the finished product; this means that this solution requires the intervention of a person having detailed knowledge of the operation of the textile machine to which the feeders are connected.

Again, the feed device command signals have to satisfy precise intervention times: for example, "anti-rebound" systems are normally provided in the feeders to prevent an electromagnetic disturbance from being interpreted as a command signal. However, this contrasts with the fact that normally the chain programmes are managed not on a time basis but spatially (i.e. on the basis of the number of cylinder revolutions and the division of each revolution into degrees, hence the term revolutions/degrees). It is hence apparent that the time duration of a command signal is linked not only to the physical position in which it is programmed (revolutions/degrees), but also of the velocity with which the machine is operating at that precise instant, in accordance with the known space-time relationship.

This is therefore difficult for the operator, and requires much experience in generating a chain programme which is not influenced by the machine production velocity; this velocity is in fact normally varied by the operator on the basis of production requirements and production stages; for example while the machine is heating, the machine velocity is normally lower.

Another known solution is based on the fact that many feeders instead comprise serial communication which interfaces with the textile machine control unit, usually of microprocessor type, by which the set point value can be programmed. This solution is obviously decidedly more flexible than the aforegoing, however it still presents the following limits:

- the textile machine must already be arranged for serial management of said feeders. This solution is therefore not applicable to all machine types present on the market, in particular in the case of application to old machines;
- this solution compels yarn feeder manufacturers to cooperate with the various textile machine constructors, as evidently each device has its specific communication protocol and depends on the required communication standard of the textile machine control unit.

Finally, if improvements are made to the feed device, for example by increasing the system resolution, it is not possible to utilize this function on already operating machines without requesting the intervention of the constructor of these latter to modify the feeder management software.

An object of the present invention is to provide an improved system and method for managing the feed of a plurality of yarns at constant tension and/or velocity to a textile machine.

A particular object of the invention is to provide a system of the stated type which enables each feeder to be easily managed in terms both of programming and of interfacing with the textile machine.

Another object is to provide a system of the stated type which enables flexible management (i.e. different programming for each feed device) without requiring the use of resources or rather of programmable outputs of the machine.

Another object is to provide a system and method of the stated type which enables feed devices to be managed on any textile machine, even if not arranged for this.

Another object is to provide a method of the stated type which enables the machine operating programme or "programme chain" to be generated in a manner which is simple and intuitive for the operator, without the operator having to worry about its manner of intervention on the feeders, but only of its result on the finished product.

Another object is to provide a system of the stated type which enables the feeder manufacturer to provide a design which is independent of the textile machine on which the feeder is to operate, so enabling the manufacturer to continue to develop and improve the product or family of products, without having to worry about any compatibility difficulty with textile machines, whether already operative or not, as no internal prearrangement of these latter is required, other than the generation of one or two synchronization signals by them.

A further object is to is to provide a system and method of the stated type which enable articles to be created with "fancy effects" in a manner simple for the operator, the term "fancy effects" meaning a zone (repetitive or random) within the work in which the working tension (in the sense of set point) varies repetitively (in accordance with a precise rule, for example with the sequence 2.0→2.5→1.5→2.5→2.0 or randomly).

A further object is to provide a system of the stated type which can be standardized to be usable with any textile machine of any make, model or year of production.

These and further objects which will be apparent to the expert of the art are attained by a system and method in accordance with the accompanying claims.

The present invention will be more apparent from the accompanying drawing, which is provided by way of non-limiting example and in which the single FIGURE shows a scheme of a system obtained in accordance with the invention.

With reference to said FIGURE, this shows various feed devices 1 for feeding yarns (not shown) to a textile machine 2, these devices being shown specifically as mutually different to indicate how the system can contain different yarn feeders 1.

The devices 1 are all connected to an interface unit 3, preferably of the microprocessor type. This interface unit can present a display and/or a keyboard 5 by which an operator can insert or select operating modes for the unit 3 and hence for the system (i.e. an "operating programme" for this latter) and utilize, via the display, information relative to these modes and/or relative to the system operation. The display and/or the keyboard 5 are connected to the unit 3 via a connection line 10. In an improved embodiment, the unit 3 also commands and controls the operation of each device 1.

The interface unit 3 is arranged to manage and modify the set point of the devices 1 for feeding yarn at constant tension and/or velocity. As stated, these devices can be of the same type or be of mutually different type. The management and programming of said devices preferably takes place via a serial line 4 which connects to the unit 3, hence simplifying and consequently reducing the system cabling costs, in particular when the number of devices 1 is particularly high (such as in the case for example of medium and large diameter circular machines).

The invention (method and system) is based on the fact that in nearly all textile processes, in particular for small and medium diameter circular machines, the production process can be divided into a series of repetitive cycles, where one cycle corresponds to the production of a single item (for example a stocking).

Based on this consideration, the unit 1 operates by receiving from the textile machine 2, via electrical or serial connection lines 7 and 8, only two synchronization signals identified by ZPX and PRX, namely a cycle end/working commencement signal and a signal relative to the undergoing of a complete revolution of the cylinder respectively; this enables them always to identify in an absolute and certain manner the state of work advancement of the textile machine.

It is very simple to obtain said ZPX and PRX signals on textile machines which operate in this manner (for example, on circular machines of small and medium diameter), they being obtainable even if the machines are not already set to generate said signals during their construction stage. In fact the PRX signal can be generated by a simple proximity sensor which measures the number of revolutions of the machine cylinder or of any other rotation member; The ZPX signal can be instead generated by a sensor, always present on this type of machine, which controls the expulsion of the item or finished product or can be generated by the programme chain (i.e. the machine operating programme) and fed to the unit 3 by using two programmable outputs (not shown) of a control unit for the machine (also not shown), of known type.

The unit 3 receives, via a further communication port and a connection line (electrical or serial) 10, data relative to the "operating programme" associated with the production article, i.e. relative to the productive modes of each individual portion of said article, data which are saved within a memory present in the unit. In this respect, as stated, this article can comprise parts or zones obtained with different yarns or with the same yarn, but fed to the textile machine with different tension and/or velocity so as to obtain said zones with characteristics (for example of strength or compactness or appearance) individual to the part itself and different from those of the adjacent product zones.

By loading said data or operating programme, the unit 3 is able to obtain and set (and possibly control) the operation of each individual feed device 1 with specific modalities which are a function of the article under production, its productive stage and the yarn used for its production. This loading takes place for example via a PC connected to the unit 3, via a USB key, an SDI card, an Ethernet connection, WiFi connection or similar devices (exemplified by way of example by a block 11 in the FIGURE).

The "operating programme" comprises a table of the following type.

| STEP/PRX | DEV-(1) | DEV-(2) | ... | DEV-(n − 1) | DEV-(n) |
|---|---|---|---|---|---|
| 1 | SP(1,1) | SP(1,2) | | SP(1,n − 1) | SP(1,n) |
| 2 | SP(2,1) | SP(2,2) | | SP(2,n − 1) | SP(2,n) |
| N − 1 | SP(N − 1,1) | SP(N − 1,2) | | SP(N − 1,n − 1) | SP(N − 1,n) |
| N | SP(N,1) | SP(N,2) | | SP(N,n − 1) | SP(N,n) |

In the aforegoing table, the term "step" indicates the advancement state of the working cycle (progressive number for example of the PRX pulses or of the cylinder revolutions received by the machine 2); for each step, a column is provided associated with each feed device (DEV n) in which for the specific feeder, the reference tension and/or velocity SP(x, y) associated with the specific productive stage is memorized. Evidently this table is composed of as many rows as the "steps" for the article under production, corresponding to different productive stages of the article, i.e. the production of each of its individual parts (linked precisely to each cylinder revolution).

This "operating programme" is set by an operator and comprises, for example, subdividing the individual production cycle of an article into its different working zones (for example for a stocking: cuff, leg, ankle, heel, foot, toe) and defining for each working zone simply the number of constituent "steps" of the zone, for example 30; on the basis of this division, defining for each subdivision the initial feed tension and/or velocity, the final tension and/or velocity, and possibly the number of steps in which the change has to take place (for example: initial tension of device 1 equal to 2.0 grams; final tension equal to 3.0 grams, to be reached in five steps). The working tension can also be caused to vary repetitively within a working zone or even within a single step to achieve fancy effects on the article.

This working zone can be repetitive or random in the series of articles produced.

The unit 3 hence provides operating data to each device 1 for each zone in accordance with a specific table.

An example relative to the production of a cuff (zone) of a stocking is given in the following table.

| ZONE | STEP/PRX | DEV-(1) | DEV-(2) | . . . | DEV-(n − 1) | DEV-(n) |
|---|---|---|---|---|---|---|
| CUFF | 1 | 2.0 | | | | |
| | 2 | 2.2 | | | | |
| | 3 | 2.4 | | | | |
| | 4 | 2.6 | | | | |
| | 5 | 2.8 | | | | |
| | 6 | 3.0 | | | | |
| | 7 | 3.0 | | | | |
| | 29 | 3.0 | | | | |
| | 30 | 3.0 | | | | |

Hence by virtue of the invention, for the operator the management of each individual feed device 1 of a plurality of devices is extremely simple: it is in fact the "operating programme" of the unit 3 which implements any passage from one tension and/or velocity to the other by utilizing the maximum possible resolution (i.e. the minimum programmable tension) of the device to be managed. By using a unit 3 operating in accordance with the aforegoing description, it also becomes very simple for the operator to intervene and modify the final result during the article definition stage.

Consequently, the unit 3 operates in accordance with a method consisting of subdividing the operating mode for obtaining each individual article into a series of production steps for each individual zone of the article, said production steps being identified by signals corresponding to each cylinder revolution. On the basis of this division, for each individual step and for each individual feed device 1, the unit 3 sets (and advantageously manages) the operation of this latter, its mode of intervention on the yarn (i.e. the definition of its feed tension and/or velocity); the unit 3 can also control the production of the article in each of its individual portions, i.e. in each part of each of its individual zones. In this case, the unit 3 intervenes on each individual device 1 in order to maintain the yarn characteristic (tension and/or velocity) controlled at a value which corresponds to that which has been predefined or programmed or defined after an initial verified and accepted sample product (i.e., in general terms, "set") chosen for each individual portion of each individual product zone. If the measured value and the set value do not correspond, the unit 3 is able to intervene on the individual device to equalize these values.

From the aforegoing, it is evident that the unit 3, by operating in the modes corresponding to the tabled data relative to each working zone, and knowing the machine operating state by the analysis of the PRX and ZPX pulses received, is able to modify the set point of each device on the basis of the state of advancement of the work; in fact for each connected device 1 the control unit 3 has simply to limit itself to modifying the set point of that device at each PRX pulse received.

As the "operating programme" is the result of data set in the unit 3 in a manner independent of the textile machine 2 and of the type of feeder 1 connected, it is evident that the operating data of the unit 3 can be set differently on the basis of each type of feeder 1 or possibly of the hardware/software version of the feed device connected, hence enabling the yarn feed device manufacturer to continue to develop his own products independently of the need to maintain compatibility with the particular textile machine to which such products are to be connected, or compatibility with other feed devices connected to the machine.

A particular embodiment of the invention has been described. However the following modifications can be made to that described heretofore.

In a variant, the individual feeders 1 can be managed by the control and interface unit 3 not via the serial line 4 but via a series of hardware exit commands from the unit (INC, DEC or other commands), as provided for by the state of the art in certain feed devices.

According to another variant, the ZPX signal is not provided, the unit 3 recognizing passage from the cycle (n) to the cycle (n+1) by time-out, i.e. by measuring the time interval during which PRX signals are not generated.

Alternatively, the unit senses this passage as a time interval in which no device 1 is in the feed stage. If the ZPX signal is not present, the unit 3 can also recognize passage from the cycle (n) to the cycle (n+1) every N pulses of the PRX signal. This solution can be advantageously utilized for large diameter circular machines or for continuous working machines (such as tape production looms) where the length of a cycle is predefined, for example equal to 1524 PRX.

According to a further variant, the PRX signal can be withdrawn not as a pulse at every revolution, but as several pulses per revolution (for example by connecting the unit 3 to the encoder usually associated with the machine). In this case, resolution in terms of working tension (and/or velocity) programming is decidedly greater.

Moreover, advantageously the table corresponding to each device for each step can include not only the yarn feed tension and/or velocity, but also the activation of special functions, such as that for recognizing any broken yarn. Hence in this case the broken yarn function would be enabled and disabled at the working zone of the device 1 automatically by the unit 3, hence recognizing the absence or breakage of a yarn or its use in an undesirable zone.

The "operating programme" can be optimized in terms of space (memory occupation), for example by showing in the tables only the variations of state for each device.

In a further alternative embodiment, the table showing tension settings based on the work advancement state could be contained in the memory of each feed device 1 and the PRX and ZPR synchronization signals be made to reach the feed devices 1 either directly or via the unit 3.

In another variant, the display and/or keyboard 5 operates as the control unit 3 and interfaces directly with the feed devices 1 and synchronization signals ZPX and PRX.

In a further variant of the invention, the display and/or keyboard 5 is either external to the control unit 3 or in fact does not exist.

Finally, according to a further variant, a first device 1 of the plurality of devices contains the unit 3, the other devices 1 of said plurality receiving the setting of said first device 1. In the mode in which the unit 3 also controls the operation of each feed device, if the unit 3 is contained in the aforesaid first device 1, this latter commands and controls the operation of all the other feed devices mounted on the machine.

These variants are also to be considered as falling within the scope of the following claims.

The invention claimed is:

1. A system for managing the feed of a plurality of yarns at constant tension and/or velocity to a textile machine of circular, loom or yarn preparation type, said yarns being fed to said machine by a plurality of feed devices, comprising:

setting control means connected to said plurality of devices and arranged to set their operation, said setting control means receiving synchronization signals from the machine and measuring on the basis of these signals every portion of a production cycle or of the working advancement state of an article or of a production process, said production cycle being divided into different stages, the setting control means for acting on each individual feed device on the basis of said stages such that each feed device:

feeds the respective yarn with predefined tension and/or velocity individual to each of said stages and/or controls the respective yarn with predefined tension and/or velocity individual to each of said stages, wherein the setting control means comprises an interface, command and control unit, wherein the synchronization signals originating from the textile machine comprise at least one signal corresponding to each revolution undergone by a cylindrical operating member of said machine, for each stage of the article production cycle corresponding to the manufacture of each part or zone of the article, said stage being defined and measured by the interface, command and control unit by means of said synchronization signals, values are set for at least one characteristic of the yarn fed by each feed device, said characteristic comprising at least one from tension, velocity, and yarn presence, said interface, command and control unit programming these values set on the feed devices, the values of each fed yarn characteristic are tabulated within the interface, command and control unit such that at each individual part or zone of the manufactured product, for each individual revolution of the machine cylindrical member and for each individual feed device, a set datum is scheduled with which to possibly compare the corresponding current value measured by the interface, command and control unit of the feed device.

2. A system as claimed in claim 1, wherein the setting control means are arranged to command and control the operation of each feed device of the plurality of devices on the basis of data preset and memorized in said setting control means, said command and control being carried out such that the yarn feed by said devices conforms to said preset and memorized data.

3. A system as claimed in claim 1, wherein the interface, command and control unit, is interposed between all the individual feed devices and the textile machine, said unit being programmable.

4. A system as claimed in claim 1, wherein each individual feed device is connected to the interface, command and control unit by one or other of the following modes:

serial communication, electrical signals arranged to recognize hardware commands generated by said interface, command and control unit.

5. A system as claimed in claim 4, wherein the electrical signals arranged to recognize hardware commands generated by said interface, command and control unit are INC or DEC commands.

6. A system as claimed in claim 1, wherein said signal corresponding to each revolution of the machine cylindrical member of said machine is either a single signal generated at each revolution or a plurality of signals generated every individual revolution.

7. A system as claimed in claim 1, wherein the synchronization signals also comprise a production cycle end/commencement signal for each individual article.

8. A system as claimed in claim 7, wherein for the generation of said production cycle end/commencement signal, selective provision is made for:

a production cycle end/commencement sensor which controls the expulsion of the finished article of the textile machine; or a measurement of a time period in which no signal is generated corresponding to one revolution of the cylindrical operating member of the machine, or a measurement by the interface, command and control unit of the stoppage of yarn feed by all the feed devices active for producing the article, or a measurement of the attainment of a predefined number of signals corresponding to each revolution of the cylindrical operating member of the machine.

9. A system as claimed in claim 1, wherein said interface unit forms part of a feed device of the plurality of feed devices.

10. A method for managing the feed of a plurality of yarns at constant tension and/or velocity to a textile machine of circular, loom or yarn preparation type, said method being implemented by a system for managing the feed of a plurality of yarns at constant tension and/or velocity to a textile machine of circular, loom or yarn preparation type, said yarns being fed to said machine by a plurality of feed devices, comprising:

setting control means connected to said plurality of devices and arranged to set their operation, said setting control means receiving synchronization signals from the machine and measuring on the basis of these signals every portion of a production cycle or of the working advancement state of an article or of a production process, said production cycle being divided into different stages, the setting control means for acting on each individual feed device on the basis of said stages such that each feed device:

feeds the respective yarn with predefined tension and/or velocity individual to each of said stages and/or controls the respective yarn with predefined tension and/or velocity individual to each of said stages, wherein the setting control means comprises an interface, command and control unit, wherein the synchronization signals originating from the textile machine comprise at least one signal corresponding to each revolution undergone by a cylindrical operating member of said machine, for each stage of the article production cycle corresponding to the manufacture of each part or zone of the article, said stage being defined and measured by the interface, command and control unit by means of said synchronization signals, values are set for at least one characteristic of the yarn fed by each feed device, said characteristic comprising at least one from tension, velocity, and yarn presence, said interface, command and control unit programming these values set on the feed devices, the values of each fed yarn characteristic are tabulated within the interface, command and control unit such that at each individual part or zone of the manufactured product, for each individual revolution of the machine cylindrical member and for each individual feed device, a set datum is scheduled with which to possibly compare the corresponding current value measured by the interface, command and control unit of the feed device, said yarns being fed to said machine by a corresponding plurality of feed devices, the method comprising:

measuring individual stages of a production cycle or of the working advancement state of an article or of a production process, said stages corresponding to production steps of individual zones of said articles;

associating, with each of said stages, particular set values of at least one characteristic of the yarn fed by each feed device, the characteristic being chosen from its tension, its velocity, and its presence;

memorizing said values within setting control means to which said feed devices are connected; and causing said setting means to intervene in the operation of said feed devices to feed each yarn in accordance with memorized values, the individual production stages being measured by measuring at least each revolution of a cylindrical operating member of the circular textile machine, wherein a tabulation of the various set values of each characteristic of the controlled yarn is provided on the basis of each individual operating step of the textile machine corresponding to each cylindrical member of this textile machine, said set values being grouped for each zone or portion of the article produced.

11. A method as claimed in claim 10, said setting control means measure corresponding real or current values of the yarn characteristic controlled during the feed of each yarn to the machine by each feed device; said real or current values being compared with the set values, and intervention taking place on each device if a difference between said real or current values and the set values is noted.

12. A method as claimed in claim 10, comprising at least one of the following characteristics:

the set value of the controlled yarn characteristic such as the tension and/or the feed velocity, is either programmed, prefixed or defined after forming a verified and accepted sample product;

the end/beginning of each production cycle of the complete article is measured;

the setting control means are defined by the interface, command and control unit, interposed between all the feed devices and the textile machine, said interface, command and control unit comparing the set values with the real or current values obtained by said unit via the connection with each individual feed device, said interface, command and control unit intervening on each said device whenever the set values and current values differ from each other, such as to make said current values equal to the set values;

the controlled yarn characteristic is varied within at least a single stage of the production cycle of a series of articles, this variation taking place either repetitively or randomly.

* * * * *